United States Patent [19]

Morrison et al.

[11] 3,932,957

[45] Jan. 20, 1976

[54] TOY VEHICLE

[75] Inventors: Howard J. Morrison, Deerfield; Donald F. Nix, Hanover Park, both of Ill.

[73] Assignee: Marvin Glass & Associates, Chicago, Ill.

[22] Filed: Feb. 12, 1975

[21] Appl. No.: 549,498

[52] U.S. Cl. ..... 46/206; 46/202; 46/209

[51] Int. Cl.[2] ..... A63H 17/00; A63H 29/20

[58] Field of Search ..... 46/202, 206, 209, 211, 46/244 R

[56] References Cited

UNITED STATES PATENTS

| | | | |
|---|---|---|---|
| 684,993 | 10/1901 | Loree | 46/209 |
| 3,229,413 | 1/1966 | Bross | 46/209 |
| 3,517,458 | 6/1970 | Sato | 46/211 |
| 3,621,607 | 11/1971 | Morrison et al. | 46/206 |
| 3,650,067 | 11/1969 | Greenwood | 46/206 |
| 3,798,831 | 3/1974 | Higashi | 46/206 |
| 3,871,129 | 3/1975 | Tong | 46/244 R |

*Primary Examiner*—Louis G. Mancene
*Assistant Examiner*—Robert F. Cutting
*Attorney, Agent, or Firm*—Coffee & Sweeney

[57] ABSTRACT

A self-propelled toy vehicle wherein at least one driving wheel also provides a gyroscopic effect on the travel of the vehicle. In the preferred embodiment, the toy vehicle has a single supporting and driving wheel in the form of a rotatable flywheel which is capable of storing sufficient energy to provide a gyroscopic directional effect on the vehicle. The axle of the flywheel is rotatably mounted in a frame which is pivotally mounted about a vertical axis on and relative to the toy vehicle body. Rapid rotation of the flywheel to drive and direct the vehicle is achieved by the use of a flexible rack engageable with a pinion gear on the axis of the wheel. During travel, the vehicle body can rotate in a horizontal plane about said vertical axis relative to the flywheel and its frame, and thus give the impression of a vehicle skidding out of control even though the flywheel continues to move along a straight line under the gyroscopic effect of the flywheel. In the exemplary embodiment, a latch-release mechanism is provided to hold the body relative to the flywheel frame in a forward orientation. A figure is positionable on the vehicle to hold the mechanism in latched condition, but the mechanism is released when the figure is knocked off of the vehicle.

11 Claims, 6 Drawing Figures

TOY VEHICLE

BACKGROUND AND SUMMARY OF THE INVENTION

The present invention relates to toy vehicles and is particularly directed to a toy vehicle having a gyroscopic drive flywheel.

Toy vehicles have been quite popular with children for many years, both in the form of self-propelled vehicles as well as manually propelled vehicles. There have also been instances where a gyroscopic rotor in the form of a flywheel was combined with a toy vehicle to provide a directional source of driving energy for the vehicle. An example of this type is disclosed in U.S. Pat. No. 3,621,607 which issued Nov. 23, 1971. The present invention utilizes a gyroscopic flywheel as the self-propelling and supporting means for the vehicle. The flywheel is rotatably mounted on a frame so as to engage a suitable supporting surface. The frame which mounts the flywheel also is pivotal about a vertical axis relative to the vehicle body so that the vehicle can move along the supporting surface in one direction dictated by the flywheel while the vehicle body can rotate in a horizontal plane relative to the flywheel about said vertical axis.

It therefore is an object of the present invention to provide a toy vehicle of the character described having a single supporting wheel, wherein the supporting wheel is a flywheel adapted to store energy and to transfer such energy directly to the supporting surface to propel the vehicle along in a straight path while the vehicle body itself can rotate out of alignment with the path of travel.

In the illustrated embodiment, the toy vehicle comprises a body, a wheel support means rotatably mounted about a generally vertical axis on the body, and a single supporting wheel rotatably mounted on the wheel support means about a generally horizontal axis in position for peripheral engagement with the supporting surface. The toy vehicle includes a gear rack engageable with a pinion gear on the flywheel for effecting rapid rotation of the flywheel whereby the flywheel serves as a gyroscopic rotor to guide the vehicle along a straight line, as well as providing a balancing drive wheel for the vehicle.

The toy vehicle also has a spring biased latch-release mechanism operatively associated between the flywheel frame and the vehicle body. A figure is positionable on top of the vehicle engageable with a portion of the latch-release mechanism to hold the vehicle body in a forwardly directed disposition (i.e., the direction of movement of the vehicle in response to rotation of the flywheel). If the figure is knocked off of the vehicle, the latch-release mechanism assumes a release condition as the vehicle body is capable of rotating in a horizontal plane relative to the flywheel frame. In the exemplary embodiment, the latch-release mechanism has a spring which, when released, positively effects the horizontal rotation of the vehicle body relative to the flywheel frame, thus giving the impression of a skidding or sliding vehicle.

Other objects, features and advantages of the invention will be apparent from the following detailed description taken in connection with the accompanying drawings.

DESCRIPTION OF THE PREFERRED EMBODIMENT

Figure 1:
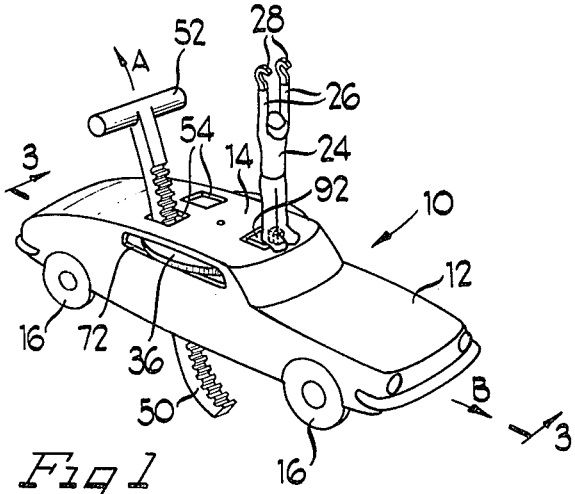
FIG. 1 is a perspective view of a toy vehicle and figure accessory, embodying the concepts of the present invention.
Figure 2:
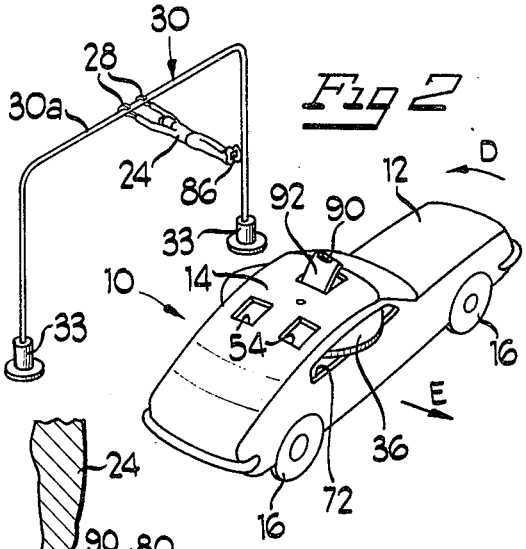
FIG. 2 is another perspective view similar to that of FIG. 1, showing the toy vehicle body in a rotated position, with the figure knocked off of the vehicle by an overhead crossbar accessory.
Figure 5:
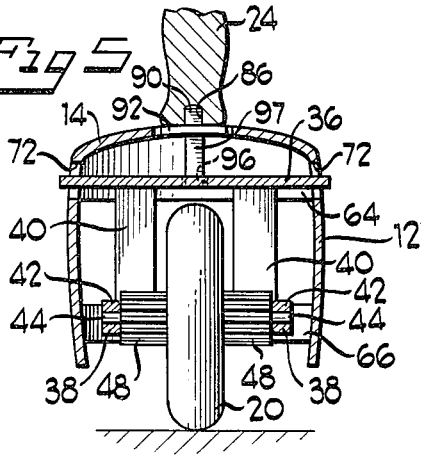
FIG. 5 is a fragmented vertical section taken generally along the line 5—5 of FIG. 3.
Figure 6:
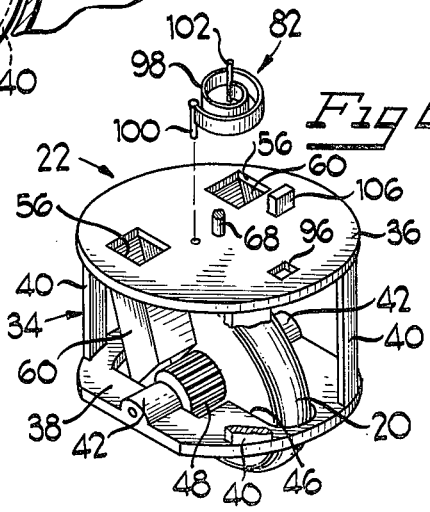
FIG. 6 is an exploded perspective view of the flywheel support frame employed in the present invention.

Referring to FIGS. 1 and 2, the invention comprises a self-propelled toy vehicle, generally designated 10, which is capable of moving across a floor or other suitable supporting surface. The vehicle 10 includes an automobile-shaped body 12 having a roof portion 14 and four non-rotatable simulated wheels 16, which may be molded integrally with the body portion 12. The power source for the toy vehicle is a gyroscopic rotor or flywheel 20, as seen more clearly in FIGS. 3, 5 and 6. The flywheel 20 is pivotally mounted on the body 12 by a wheel support means, generally designated 22 (FIG. 6), so that the vehicle 10 may perform misdirection maneuvers such as shown in FIG. 2.

A figure 24 is mountable on top of the toy vehicle 10, with upwardly extending arms 26 and hook-shaped hands 28. The hands 28 (referring to FIG. 2) are at a height to engage a crossbar accessory, generally designated 30, which pulls the figure 24 from the vehicle and thereby causes the vehicle to appear to skid out of control, as shown in FIG. 2 and as will be described in detail hereinafter.

The wheel support means 22 (FIG.6) includes a frame 34 having upper and lower disc portions 36 and 38, respectively, connected by a plurality of vertical ribs or posts 40. The lower disc 38 includes two journal bearings 42 which support opposite end portions of an axle 44 (FIG. 5) of the wheel 20 which engages the supporting surface through an elongated aperture 46 in the lower disc 38. The axle 44 includes a pinion gear 48 adjacent to, and on either side of, the wheel 20. The axle, wheel and pinion gears are secured for conjoint rotation.

A manually manipulatable flexible gear rack 50 (FIG. 1) is used in conjunction with either of the pinions 48 to rapidly rotate the flywheel 20. More particularly, the rack includes a T-shaped handle 52 for use in manually withdrawing the rack 50 past one of the pinion gears 48. The rack 50 is fed into the body 12 through one of a pair of apertures 54 in the roof portion 14. The apertures 54 are in alignment with another pair of apertures 56 (FIGS. 4 and 6) in the upper disc portion 36 of the frame 34. The apertures 56 are aligned with a pair of rack guide chutes 60, one on either side of the flywheel 20 (FIGS. 5 and 6), to maintain the rack 50 in engagement with one of the pinion gears 48. Thus, when the rack is rapidly, manually withdrawn from the toy vehicle 10 in the direction of arrow A in FIG. 1, the flywheel 20 will be rapidly rotated and will acquire a sufficient amount of kinetic energy to drive the toy vehicle 10. The flywheel is relatively heavy and also provides a gyroscopic effect to direct the vehicle in a forward direction as indicated by arrow B in FIG. 1.

The frame 34 is pivotally mounted within the vehicle body 12 so that the body may rotate relative to the direction of travel of the flywheel 20 (arrow B, FIG. 1), simulating a car which is skidding or spinning out of control as seen in FIG. 2. More particularly, the frame 34 is pivotally mounted within a pair of front and rear annular flanges 64 depending from the roof 14 and a full 360° annular flange 66 upstanding from the bottom or base of the body 12. A pin 68 in the center of the upper disc portion 36 of the frame extends into a journal 70 depending from the roof portion 14 of the body 12. The flywheel 20 and its support frame 22 is free to rotate about a vertical axis defined by the pin 68 with respect to the body 12 of the vehicle. The frame is maintained vertically by the protrusion of the upper disc 36 protruding through side slots 72 in the body.

A preset latch-release means in the form of a locking device, generally designated 80, and a biasing means, generally designated 82 (FIGS. 3 and 6), are provided in operative association between the vehicle body 12 and support frame 22 to cause the vehicle body to rotate relative to the flywheel 20 and support frame. More particularly, the figure 24 is engageable with a U-shaped crossbar 30 which is maintained in a vertical orientation by a pair of feet or suction cups 33. The hook-shaped hands 28 of the figure are engageable with a bar portion 30*a* of the accessory 30. As the vehicle passes thereunder, the figure is lifted from the roof 14 of the vehicle, whereupon the vehicle 10 appears to skid out of control (FIG. 2) as described below.

The figure 24 includes an aperture 86 in the bottom thereof which receives a two-part pin formed in the roof 14 of the toy vehicle body 12. A forward half of the pin 88 is formed on a stationary portion of the roof 14. A second or rearward half of the pin 90 is formed on a movable flap portion 92 which is pivotally mounted by a pin 94 to the roof 14. As the figure 24 engages the crossbar 30, frictional engagement of the aperture 86 with the rearward half 90 of the pin causes the flap 92 to pivot upwardly (FIG. 2). Of course, a spring loaded hinge (not shown) for the flap also is contemplated to effect upward pivoting movement of the flap. The flap 92 has a downwardly extending pin 97 (FIGS. 3 and 5) which protrudes into a rectangular opening 96 in the upper disc 36 of the frame 34. This engagement maintains the longitudinal axis of the toy vehicle body 12 in alignment with the flywheel in its forward direction of movement (as seen in FIG. 1), when the preset mechanism 80 is in its locked position (FIGS. 3, 4 and 5) held by figure 24 as described above.

Figure 3:
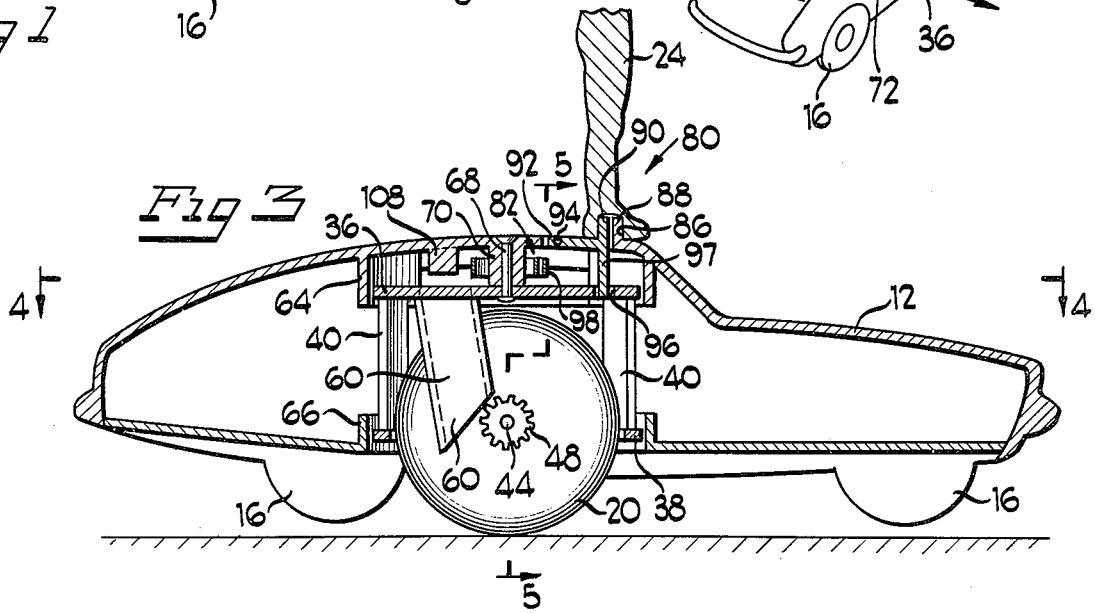
FIG. 3 is a fragmented vertical section, on an enlarged scale, taken generally along the line 3—3 of FIG. 1.
Figure 4:
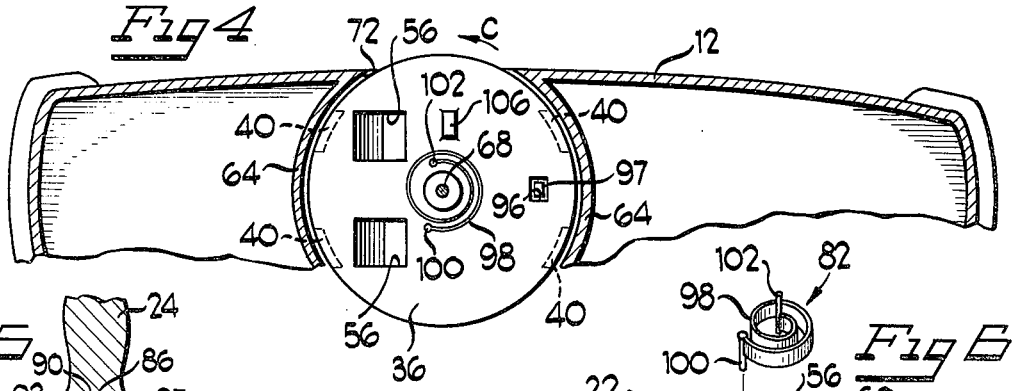
FIG. 4 is a fragmented horizontal section taken generally along the line 4—4 of FIG. 3.

A coil spring 98 is secured by one pin 100 to the frame 34 and by a second pin 102 to the roof 14 of the vehicle 10. The frame 34 is moved to the preset locked position by manual rotation of the outwardly portruding portion of the disc 36 which extends through slots 72 as shown in FIGS. 1, 3 and 4, as tension is thereby applied to the spring 98. The spring 98 when in its cocked position as shown in FIGS. 3 and 4, urges the vehicle body 12 in a counterclockwise direction as indicated by the arrow C in FIG. 4. A stop means is provided to limit the relative rotation of the frame 34 and the body 12 to approximately 90° under the influence of the spring 98. The stop means includes an upstanding tab 106 (FIG. 4) on the upper surface of the disc 36 and a depending tab 108 (FIG. 3) on the underside of the roof portion 14. When in its cocked position, as seen in FIGS. 3 and 4, the tabs 106 and 108 are separated by an arc of approximately 90° . However, when released, as described below, the spring urges the vehicle body to rotate relative to the frame 34 until the tabs 106 and 108 come into contact after which further relative rotation is not possible.

Referring to FIG. 2, it now will be apparent that as the vehicle and figure in the latched or locked condition as shown in FIG. 1, travels beneath the crossbar 30, the hooked hand portions 28 of the figure will engage and be held by the bar portion 30*a* and pulled off of the vehicle whereupon the flap 92 will be pivoted upwardly to pull the pin 97 of the flap out of the aperture 96 in the upper disc 36 of the flywheel support means 22. When this occurs, the latch-release mechanism is released and the energy stored in spring 98 causes the vehicle 12 to rotate in a counterclockwise direction as indicated by the arrow D (FIG. 2), after the vehicle passes through the crossbar 30, as the entire vehicle 10 continues to move under the gyroscopic and driving force of the flywheel in a continued direction as indicated by the arrow E (FIG. 2), thus giving the effect that the vehicle is skidding or spinning out of control when the figure is removed from the vehicle. In practice it has been found that, depending upon the relative weights of the flywheel and the body, the flywheel may rotate slightly so that the vehicle will continue to move on a course slightly different from the direction of arrow E.

Of course, it is contemplated that the figure and release-latch means of the present invention could be utilized to effect other changes in the operating characteristics of a toy vehicle in response to the figure being knocked off of the vehicle during travel.

The foregoing detailed description has been given for clearness of understanding only and no unnecessary limitations should be understood therefrom as some modifications will be obvious to those skilled in the art.

We claim:

1. A toy vehicle comprising:

a body;

pivotal wheel support means mounted on the body for rotation relative thereto about a generally vertical axis;

a supporting wheel mounted on the wheel support means for rotation about a generally horizontal axis in position for peripheral engagement with a supporting surface to move the vehicle thereover, said supporting wheel comprising a flywheel being capable of rotation at a speed sufficient to provide a gyroscopic action with respect to the entire vehicle; and means for effecting rapid rotation of said wheel, whereby said wheel serves as a gyroscopic rotor to guide the vehicle along a straight line irrespective of the angular orientation of the body about said vertical axis relative to the flywheel.

2. The toy vehicle of claim 1 wherein said flywheel is of sufficiently heavy weight relative to the vehicle body so that the kinetic energy of the flywheel provides a balancing drive means for the vehicle.

3. The toy vehicle of claim 1 wherein said means for effecting rotation of the wheel includes a manually movable gear rack and said flywheel has a shaft journalled in said wheel support means, the shaft including a pinion gear engageable by the gear rack whereby pulling of said gear rack provides rapid rotation of said wheel.

4. The toy vehicle of claim 1 wherein the wheel support means includes a frame rotatably mounted on said body for relative rotation therebetween about said vertical axis, said frame including journal bearing means, and said wheel being secured to a shaft journalled in said journal bearing means.

5. A toy vehicle comprising:

a body;

wheel support means mounted on the body for rotation relative thereto about a generally vertical axis;

a supporting wheel mounted on the wheel support means for rotation about a generally horizontal axis in position for peripheral engagement with a supporting surface to move the vehicle thereover, said supporting wheel comprising a flywheel being capable of rotation at a speed sufficient to provide a gyroscopic action with respect to the entire vehicle;

means for effecting rapid rotation of said wheel whereby said wheel serves as a gyroscopic rotor to guide the vehicle along a straight line irrespective of the angular orientation of the body about said vertical axis relative to the flywheel; and selectively actuatable biasing means between the body and the wheel support means to positively rotate said body relative to said wheel and wheel support means about said vertical axis as the vehicle moves across the supporting surface.

6. The toy vehicle of claim 5 including means for releasably locking the wheel support means in a cocked position with the flywheel in alignment with the longitudinal axis of the body whereby on release of the locking means said biasing means is effective to cause relative rotation between the wheel support means and the vehicle body.

7. The toy vehicle of claim 6 including a figure toy positionable on said vehicle operatively associated with the releasable locking means so as to hold the same in locked condition and to release the same on removing the figure toy from the vehicle.

8. The toy vehicle of claim 5 including stop means between the wheel support means and the vehicle body to limit relative vehicle body rotation therebetween.

9. The toy vehicle of claim 8 wherein said stop means limits said relative rotation to approximately 90°.

10. A gyroscopic toy vehicle, comprising:

a vehicle body;

a gyroscopic rotor fixed to an axial shaft journalled at its opposite ends on a gimballed rotor support means, said rotor support means being rotatably mounted on said vehicle body on an axis at an angle to said rotor axial shaft, and;

means for effecting rapid rotation of said gyroscopic rotor.

11. A gyroscopic, flywheel-type toy vehicle, comprising:

a vehicle body;

a ground engageable flywheel rotatably mounted on said vehicle body for peripheral engagement with a supporting surface to propel the vehicle thereover;

means for effecting rapid rotation of said flywheel, whereby said flywheel serves as a gyroscopic rotor to guide the vehicle along a generally unidirectional path as well as propel the vehicle over the surface;

actuatable means for changing the directional operating characteristics of the vehicle; and a figure toy positionable on said vehicle operatively associated with said actuatable means to actuate the same upon removal of the figure toy from the vehicle.

* * * * *